US008769975B2

(12) United States Patent
Lee et al.

(10) Patent No.: US 8,769,975 B2
(45) Date of Patent: Jul. 8, 2014

(54) APPARATUS FOR REFRIGERATION CYCLE AND REFRIGERATOR

(75) Inventors: Moo Yeon Lee, Seoul (KR); Jong Jin Park, Seoul (KR); Myung Ryul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 959 days.

(21) Appl. No.: 12/513,758

(22) PCT Filed: Nov. 2, 2007

(86) PCT No.: PCT/KR2007/005504
§ 371 (c)(1),
(2), (4) Date: May 6, 2009

(87) PCT Pub. No.: WO2008/056913
PCT Pub. Date: May 15, 2008

(65) Prior Publication Data

US 2010/0037650 A1 Feb. 18, 2010

(30) Foreign Application Priority Data

Nov. 9, 2006 (KR) ..... 10-2006-0110670

(51) Int. Cl.
*F25B 5/00* (2006.01)

(52) U.S. Cl.
USPC ..... 62/199

(58) Field of Classification Search
USPC ..... 62/172–175, 185, 199, 204, 210, 223, 62/226–229, 430, 437, 441, 498, 524–526, 62/198, 442
See application file for complete search history.

(56) References Cited

U.S. PATENT DOCUMENTS 3,786,648 A * 1/1974 Rice ..... 62/200
5,157,943 A 10/1992 Jaster et al.
(Continued)

FOREIGN PATENT DOCUMENTS

CN 1380527 A 11/2002
CN 1479064 A 3/2004
(Continued)

OTHER PUBLICATIONS

Chinese Office Action dated Nov. 15, 2010 issued in Application No. 200780041713.0.
(Continued)

*Primary Examiner* — Frantz Jules
*Assistant Examiner* — Emmanuel Duke
(74) *Attorney, Agent, or Firm* — Ked & Associates LLP

(57) ABSTRACT

A refrigeration-cycle apparatus is provided that includes a plurality of evaporators having various temperature bands, along with a refrigerator including a plurality of cooling compartments to enable stable and even cooling operations in various temperature bands using the plurality of evaporators. The refrigeration-cycle apparatus and the refrigerator enable individual operation of a portion of the plurality of evaporators, thereby reducing consumption of energy and enabling accurate control of an interior temperature of the refrigerator. The refrigeration-cycle apparatus includes a compressor that compresses and discharges a refrigerant, a condensing device including at least one condenser that condenses the refrigerant discharged from the compressor, a distributor that distributes the refrigerant condensed in the condensing device, and a cold air generator including a plurality of evaporators that evaporates the refrigerant distributed by the distributor. The plurality of evaporators is connected in series and parallel to one another and operates, respectively, to generate cold air having different temperature bands from one another.

20 Claims, 6 Drawing Sheets

(56) References Cited

U.S. PATENT DOCUMENTS

| | | | | | |
|---|---|---|---|---|---|
| 5,477,915 | A | * | 12/1995 | Park | 165/206 |
| 5,711,159 | A | | 1/1998 | Whipple, III | |
| 5,715,693 | A | * | 2/1998 | van der Walt et al. | 62/198 |
| 5,931,004 | A | | 8/1999 | Yoo et al. | |
| 6,327,867 | B1 | | 12/2001 | Hyodo et al. | |
| 6,370,895 | B1 | * | 4/2002 | Sakuma et al. | 62/199 |
| 6,490,877 | B2 | * | 12/2002 | Bash et al. | 62/200 |
| 6,622,498 | B2 | | 9/2003 | Park et al. | |
| 6,775,998 | B2 | | 8/2004 | Yuasa et al. | |
| 2002/0166331 | A1 | | 11/2002 | Park et al. | |
| 2004/0050083 | A1 | | 3/2004 | Yuasa et al. | |
| 2007/0033962 | A1 | | 2/2007 | Kang et al. | |

FOREIGN PATENT DOCUMENTS

| | | | | | |
|---|---|---|---|---|---|
| CN | 1532502 | A | | 9/2004 | |
| EP | 1 424 530 | | | 3/2004 | |
| EP | 1 394 481 | | | 6/2004 | |
| JP | 48-035550 | U | | 4/1973 | |
| JP | 55-038437 | A | | 3/1980 | |
| JP | 55-044145 | U | | 3/1980 | |
| JP | 57-196973 | U | | 12/1982 | |
| JP | 58-162456 | U | | 10/1983 | |
| JP | 01-247978 | A | | 10/1989 | |
| JP | 08-005172 | | * | 1/1996 | F25B 5/04 |
| JP | 08005172 | | * | 1/1996 | F25D 11/02 |
| JP | 2001-263902 | A | | 9/2001 | |
| JP | 2003-139459 | A | | 5/2003 | |
| JP | 2003-207249 | | * | 7/2003 | F25D 11/02 |
| JP | 2003-207249 | A | | 7/2003 | |
| JP | 2003-214743 | | * | 7/2003 | F25D 11/00 |
| JP | 2003207249 | | * | 7/2003 | F25D 11/00 |
| JP | 2003214743 | | * | 7/2003 | F25D 11/00 |
| JP | 2004078356 | | * | 3/2004 | F25D 11/00 |
| KR | 10-1996-0024150 | A | | 7/1996 | |
| KR | 19960024150 | | * | 7/1996 | F25D 11/00 |
| KR | 10-1998-017939 | A | | 6/1998 | |
| KR | 10-2000-0022624 | A | | 4/2000 | |
| KR | 20000022624 | | * | 4/2000 | F25D 11/00 |
| KR | 10-2002-0085373 | A | | 11/2002 | |
| KR | 10-2003-0062212 | A | | 7/2003 | |
| KR | 10-2006-0017727 | A | | 2/2006 | |
| WO | WO 96/15413 | | | 5/2006 | |

OTHER PUBLICATIONS

Korean Decision to Grant a Patent dated Dec. 20, 2007 issued in Application No. 10-2006-0110670.

Chinese Office Action dated May 25, 2010 issued in Application No. 200780041713.0.

Korean Decision to Grant a Patent dated Feb. 1, 2008 for Application No. 10-2006-0133846.

International Search Report dated Jun. 10, 2008.

* cited by examiner

APPARATUS FOR REFRIGERATION CYCLE AND REFRIGERATOR

TECHNICAL FIELD

The present invention relates to a refrigeration-cycle apparatus and a refrigerator, and more particularly, to a refrigeration-cycle apparatus capable of stably generating cold air of various temperature bands, and a refrigerator employing the refrigeration-cycle apparatus to realize cooling compartments generating cold air of various temperature bands.

BACKGROUND ART

Generally, a refrigeration cycle is a thermodynamic cycle that absorbs heat from a cooling substance and transmits the absorbed heat to a heating substance. The most basic apparatus constituting the refrigeration cycle includes a compressor, a condenser, an expansion valve, and an evaporator.

The compressor serves to compress a refrigerant and discharge a high-temperature and high-pressure gas-phase refrigerant. The condenser serves to condense the high-temperature and high-pressure gas-phase refrigerant discharged from the compressor and make a normal-temperature and high-pressure or low-temperature and high-pressure liquid-phase refrigerant. The normal-temperature and high-pressure or low-temperature and high-pressure refrigerant is expanded while passing through the expansion valve, to thereby be changed into a low-temperature and low-pressure refrigerant. The expanded refrigerant is evaporated in the evaporator, and is further lowered in temperature and pressure. In the process of evaporation, the refrigerant draws heat from the surroundings, thereby cooling the surrounding air.

After completing a one-cycle circulation as described above, the refrigerant is returned to the compressor and compressed again, and the above described cycle is repeatedly carried out. The evaporator operates to draw heat from the surroundings and generate cooled air, namely, cold air. A refrigerator is configured to cool the interior of a cooling compartment by blowing the cold air into the cooling compartment under the operation of a fan.

Providing a conventional refrigerator, including a freezing compartment and a refrigerating compartment, with the above described refrigeration-cycle apparatus, an evaporator is installed in the freezing compartment to generate cold air having a temperature band required for the freezing compartment. In this case, the cooling of the refrigerating compartment is accomplished as a part of the cold air generated in the freezing compartment is supplied into the refrigerating compartment. A problem of this cooling manner is that the refrigerating compartment has a very uneven temperature distribution, and moreover, the temperature distribution of the freezing compartment also becomes uneven as the cold air is transmitted into the refrigerating compartment.

To solve the above described problem, there is the rise of the technology of independently controlling temperatures of the freezing compartment and the refrigerating compartment and providing the freezing compartment and the refrigerating compartment with an even temperature distribution.

The conventional refrigerator includes only the freezing compartment, serving as a cooling compartment of a relatively low-temperature band, and the refrigerating compartment serving as a cooling compartment of a relatively high-temperature band. Nowadays, there is the rise of the technology for a refrigerator including a variety of cooling compartments having different temperature bands from one another, for example, a cooling compartment having a medium temperature band between those of the refrigerating compartment and the freezing compartment, or a cooling compartment having a temperature hand higher than that of the refrigerating compartment, to satisfy the consumer's demand.

DISCLOSURE OF INVENTION

Technical Problem

An object of the present invention devised to solve the problem lies on a refrigeration-cycle apparatus, which includes a plurality of evaporators having different temperature bands from one another, and a refrigerator, which includes a plurality of cooling compartments to enable stable and even cooling operations in various temperature bands with the use of the plurality of evaporators.

Another object of the present invention devised to solve the problem lies on a refrigeration-cycle apparatus and a refrigerator, in which some of a plurality of evaporators can be operated individually, thereby achieving a reduction in the consumption of energy and enabling the accurate control of an interior temperature of the refrigerator.

Yet another object of the present invention devised to solve the problem lies on a refrigeration-cycle apparatus and a refrigerator, in which appropriate condensers can be operated selectively in consideration of an interior cooling load of the refrigerator, thereby restricting the excessive loss of condensation and resulting in improved system efficiency.

Technical Solution

The object of the present invention can be achieved by providing a refrigeration-cycle apparatus comprising: a compressor to compress and discharge a refrigerant; a condensing unit including at least one condenser to condense the refrigerant discharged from the compressor; a distributor to distribute the refrigerant condensed in the condensing unit; and a cold air generating unit including a plurality of evaporators each to evaporate the refrigerant distributed by the distributor, the evaporators being connected in series and parallel to one another and operated, respectively, to generate cold air having different temperature bands from one another.

The cold air generating unit may comprise: a first cold air generating unit to generate cold air from a part of the refrigerant distributed from the distributor; and a second cold air generating unit connected parallel to the first cold air generating unit and used to generate cold air from the remaining part of the refrigerant distributed from the distributor, the second cold air generating unit having a selective refrigerant flow with the first cold air generating unit.

The distributor may comprise a valve to supply the condensed refrigerant from the condensing unit into the first cold air generating unit and the second cold air generating unit simultaneously or selectively.

The first cold air generating unit may comprise: a first refrigerant flow-path connected to the distributor for the flow of the refrigerant; a first expander installed on the first refrigerant flow-path and used to expand the refrigerant; and a first evaporating unit including a plurality of evaporators connected in series to evaporate the refrigerant expanded in the first expander, so as to generate cold air having different temperature bands from one another.

The second cold air generating unit may comprise: a second refrigerant flow-path connected to the distributor for the flow of the refrigerant; a second expander installed on the second refrigerant flow-path and used to expand the refrigerant; an evaporator to evaporate the refrigerant expanded in the second expander, so as to generate cold air; and a connector to connect the first refrigerant flow-path and the second refrigerant flow-path to each other, to achieve a selective refrigerant flow between the first refrigerant flow-path and the second refrigerant flow-path.

The second cold air generating unit may comprise: a second refrigerant flow-path connected to the distributor for the flow of the refrigerant; a second expander installed on the second refrigerant flow-path and used to expand the refrigerant; a second evaporating unit including a plurality of evaporators connected in series to evaporate the refrigerant expanded in the second expander, so as to generate cold air having different temperature bands from one another; and a connector to connect the first refrigerant flow-path and the second refrigerant flow-path to each other, to achieve a selective refrigerant flow between the first refrigerant flow-path and the second refrigerant flow-path.

The first evaporating unit may comprise: a first-band evaporator to evaporate the refrigerant so as to generate cold air having a predetermined temperature band; a second-band evaporator to again evaporate the refrigerant having passed through the first-band evaporator, so as to generate cold air having a lower temperature hand than that of the first-band evaporator; and an intermediate expander installed between the first-band evaporator and the second-band evaporator and used to expand the refrigerant having passed through the first-band evaporator and introduce the expanded refrigerant into the second-band evaporator.

The first evaporating unit may further comprise: at last one parallel-connection evaporator connected parallel to at least one of the first-band evaporator and the second-band evaporator and used to generate cold air.

At least one of the first-band evaporator, the second-band evaporator, and the at least one parallel-connection evaporator may include an indirect-cooling type evaporator.

The condensing unit may comprise: a first condenser to condense the refrigerant to be supplied into the first cold air generating unit; and a second condenser to condense the refrigerant to be supplied into the second cold air generating unit.

The refrigeration-cycle apparatus may further comprise: a distribution valve to distribute and supply the refrigerant discharged from the compressor into the first condenser and the second condenser.

The connector may comprise: a connecting pipe to connect a position downstream of the first evaporating unit to a position downstream of the second expander, for the flow of the refrigerant; and a control valve to control the flow of the refrigerant through the connecting pipe.

The connector may comprise: a connecting pipe to connect a position between the plurality of evaporators of the first evaporating unit to a position downstream of the second expander, for the flow of the refrigerant; and a control valve to control the flow of the refrigerant through the connecting pipe.

In another aspect of the present invention, provided herein is a refrigeration-cycle apparatus comprising: a compressor to compress and discharge a refrigerant; a condensing unit including at least one condenser to condense the refrigerant discharged from the compressor; and a refrigeration-cycle unit to simultaneously or selectively perform a plurality of refrigeration-cycle operations using the condensed refrigerant from the condensing unit, so as to enable cooling operations in various temperature bands.

The refrigeration-cycle unit may comprise: a distributor to distribute the refrigerant condensed in the condensing unit into a plurality of passages simultaneously or into only a part of the passages selectively; a first cold air generating unit to perform a refrigeration-cycle operation using a part of the refrigerant distributed by the distributor; and a second cold air generating unit to perform another refrigeration-cycle operation using the remaining part of the refrigerant distributed by the distributor.

In yet another aspect of the present invention, provided herein is a refrigerator comprising: a body; a refrigeration-cycle apparatus installed in the body, and including a compressor to compress and discharge a refrigerant, a condensing unit to condense the refrigerant discharged from the compressor, a distributor to distribute the refrigerant condensed in the condensing unit, a first cold air generating unit to generate cold air from a part of the refrigerant distributed from the distributor, and a second cold air generating unit connected to the first cold air generating unit and used to generate cold air from the remaining part of the refrigerant distributed from the distributor, the second cold air generating unit having a selective refrigerant flow with the first cold air generating unit; and a plurality of cooling compartments provided in the body and adapted to be cooled, respectively, by cold air having different temperature bands from one another generated from the first cold air generating unit and the second cold air generating unit.

The first cold air generating unit may comprise a plurality of evaporators connected in series and used, respectively, to generate the cold air having different temperature bands from one another, and a part of the plurality of cooling compartments may include cooling storage compartments to be cooled, respectively, by the cold air having different temperature bands from one another generated by the plurality of evaporators included in the first cold air generating unit.

The first cold air generating unit may comprise a plurality of evaporators connected in series and used, respectively, to generate the cold air having different temperature bands from one another, and one of the plurality of cooling compartments may comprise a plurality of cooling spaces partitioned therein to be cooled, respectively, by the cold air having different temperature bands from one another generated by the plurality of evaporators included in the first cold air generating unit.

The second cold air generating unit may comprise an evaporator to generate cold air, and the remaining part of the plurality of cooling compartments may comprise a cooling storage compartment to be cooled by the evaporator of the second cold air generating unit.

The second cold air generating unit may comprise a plurality of evaporators connected in series and used, respectively, to generate the cold air having different temperature bands from one another, and the remaining part of the plurality of cooling compartments may comprise a plurality of cooling storage compartments to be cooled, respectively, by the cold air having different temperature bands from one another generated by the plurality of evaporators included in the second cold air generating unit.

A part of the plurality of cooling compartments may comprise a direct-cooling type cooling compartment realized by at least one direct-cooling type evaporator included in the first cold air generating unit or the second cold air generating unit.

Advantageous Effects

In a refrigeration-cycle apparatus and a refrigerator according to the present invention, a plurality of evaporators having different temperature bands from one another can be realized, and consequently, cooling compartments to enable cooling operations in various temperature bands can be realized. Accordingly, the resulting refrigerator can satisfy various demands of consumers. Further, as a result of providing each cooling compartment with an independent evaporator, the present invention is very advantageous not only to maintain an interior humidity of the refrigerator, but also to achieve the accurate control of an interior temperature of the refrigerator. In particular, the present invention can allow the respective evaporators to be operated individually, and reduce the consumption of energy.

Furthermore, according to the present invention, appropriate condensers can be operated selectively in consideration of an interior cooling load of the refrigerator. This has an advantage of preventing the excessive loss of condensation and resulting in improved system efficiency.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
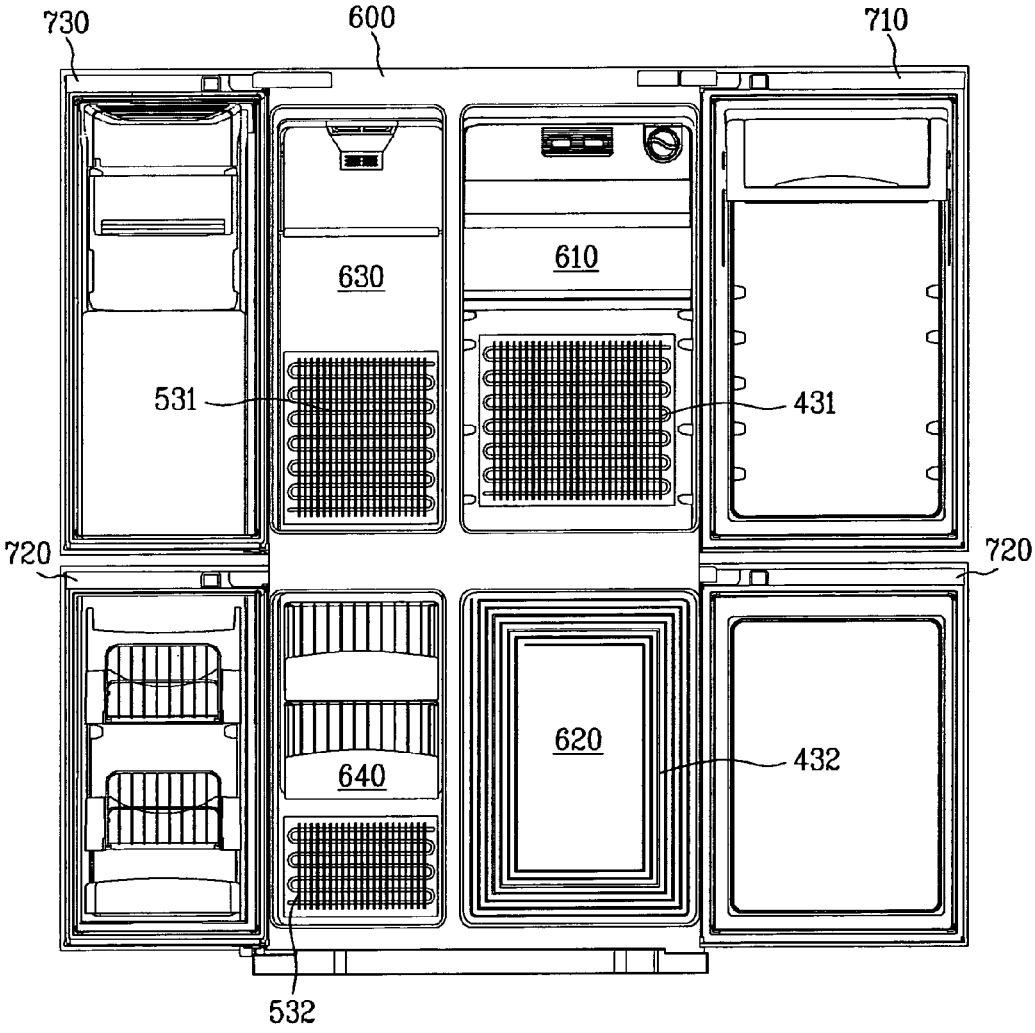
FIG. 1 is a view illustrating a refrigerator according to an embodiment of the present invention.
Figure 2:
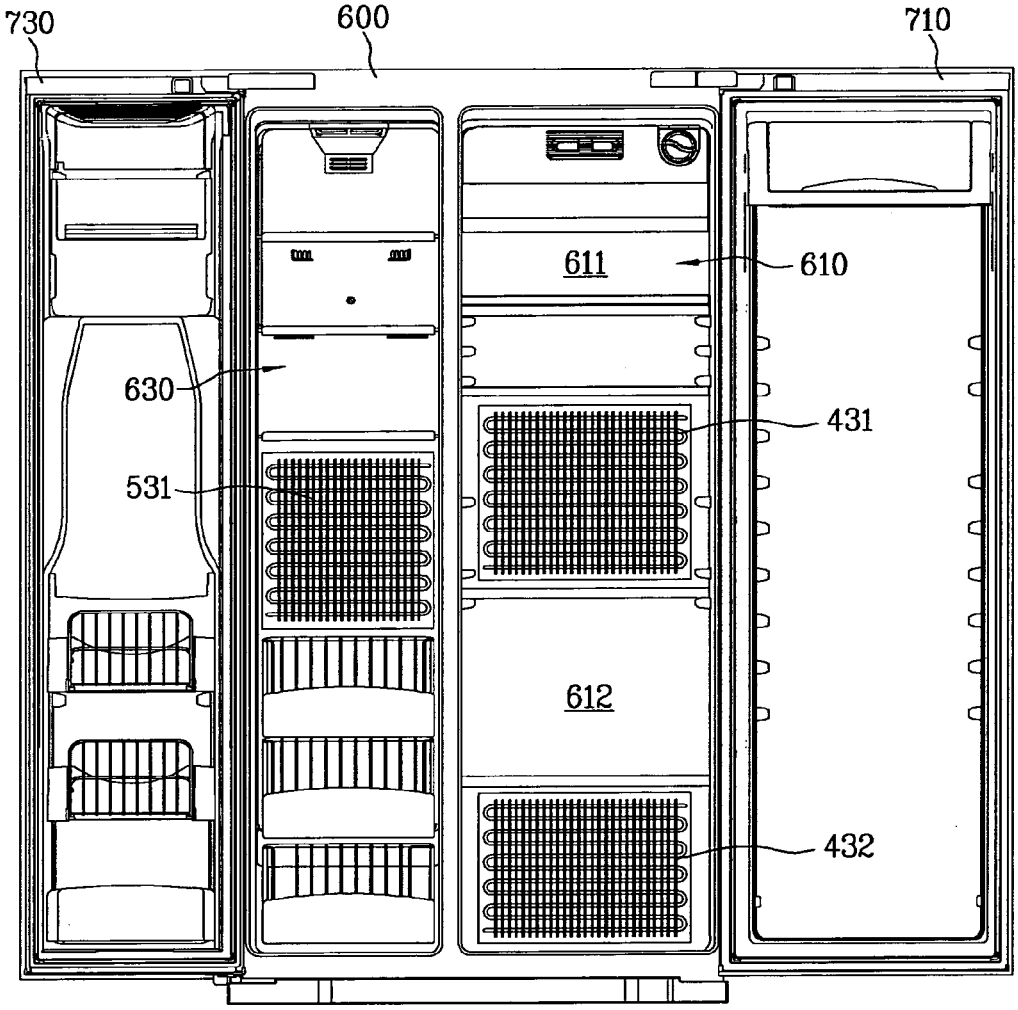
FIG. 2 is a view illustrating a refrigerator according to another embodiment of the present invention.

FIG. 1 is a view illustrating a refrigerator according to an embodiment of the present invention, and FIG. 2 is a view illustrating a refrigerator according to another embodiment of the present invention. FIGS. 3 to 8 are views illustrating different embodiments of a refrigeration-cycle apparatus according to the present invention. FIG. 9 is a PH diagram related to a refrigeration cycle realized by the refrigeration-cycle apparatus according to the present invention.

As shown in FIG. 1, the refrigerator according to the present invention includes a body 600 defining the overall outer appearance of the refrigerator, a first cooling compartment 610 provided in one side of an upper region of the body 600, a second cooling compartment 620 provided in one side of a lower region of the body 600, a third cooling compartment 630 provided in the other side of the upper region of the body 600, and a fourth cooling compartment 640 provided in the other side of the lower region of the body 600. The cooling compartments 610, 620, 630, and 640 are provided, respectively, with doors 710, 720, 730, and 740 as opening/closing means.

The refrigerator shown in FIG. 1 has a feature in that the respective cooling compartments 610, 620, 630, and 640 are cooled by cold air of different temperature bands from one another. In FIG. 1, the first cooling compartment 610, the third cooling compartment 630, and the fourth cooling compartment 640 are realized as cooling compartments of a general indirect-cooling type, and the second cooling compartment 620 is realized as a cooling compartment of a direct-cooling type and is suitable for use as a storage compartment for a Kim-chi refrigerator.

A refrigeration-cycle apparatus to generate cold air of various temperature bands for use in the above described cooling compartments will be described later.

Meanwhile, FIG. 1 illustrates one embodiment in which cooling compartments, having different temperature bands from one another, are provided independently, whereas FIG. 2 illustrates another embodiment in which a refrigerator includes two cooling compartments, and each cooling compartment includes independent cooling spaces separated from each other. It will be appreciated that the refrigerator shown in FIG. 2 has almost similar effects to the refrigerator shown in FIG. 1 that realizes the independent cooling compartments of different temperature bands from one another.

More specifically, as shown in FIG. 2, the refrigerator according to another embodiment of the present invention includes the body 600, the first cooling compartment 610 provided in one side of the body 600, and the third cooling compartment 630 provided in the other side of the body 600. Also, the refrigerator includes the first door 710 to open or close the first cooling compartment 610, and the third door 730 to open or close the third cooling compartment 630. The first cooling compartment 610 includes a first cooling space 611 partitioned in one side thereof, and a second cooling space 612 partitioned in the other side thereof.

The first cooling space 611, the second cooling space 612, and the third cooling compartment 630 are cooled by cold air having different temperature bands from one another.

Now, the refrigeration-cycle apparatus to generate cold air of various temperature bands as described above will be described with reference to FIGS. 3 to 8.

Figure 3:
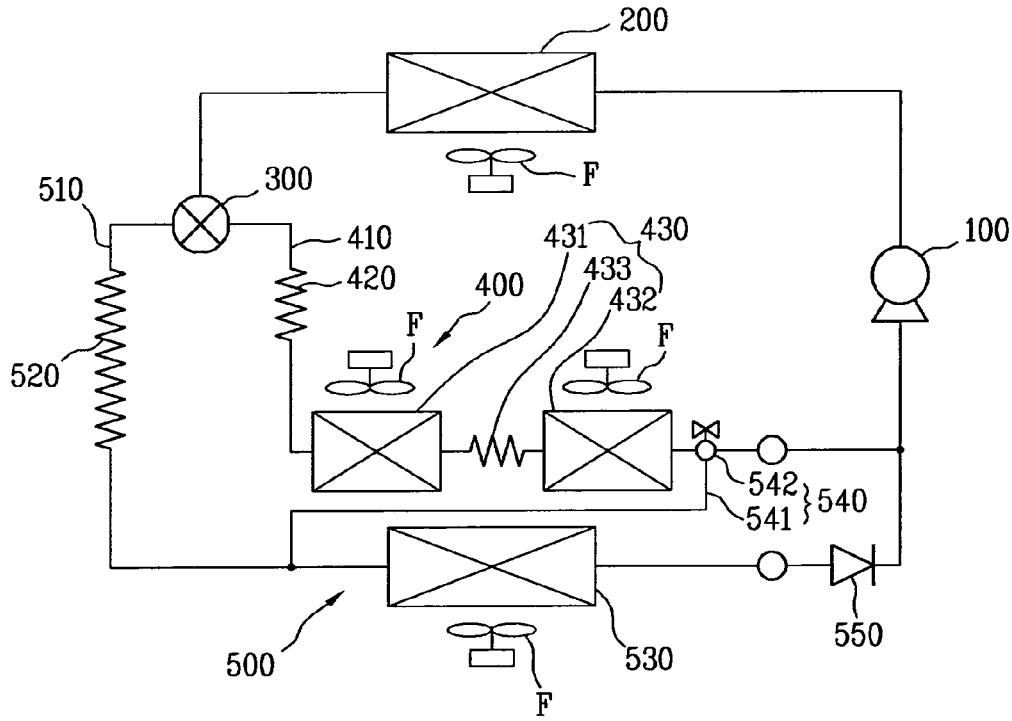
FIGS. 3 to 8 are views illustrating different embodiments of a refrigeration-cycle apparatus according to the present invention.

As shown in FIG. 3, the refrigeration-cycle apparatus according to the present invention includes a compressor 100 to compress and discharge a refrigerant, a condensing unit 200 connected to the compressor 100 and used to condense the compressed refrigerant, a distributor 300 to distribute the refrigerant, having passed through the condensing unit 200, into a first refrigerant flow-path 410 and a second refrigerant flow-path 510, and cold air generating units 400 and 500 including a plurality of evaporators 431, 432, and 530 installed on the first refrigerant flow-path 410 and the second refrigerant flow-path 510 in such a manner of being connected in series and parallel to one another, and used to generate cold air of different temperature bands from one another.

The compressor 100 may be a variable-capacity compressor that can regulate the amount of a refrigerant to be compressed and thus, can change a cooling capability according to different refrigeration loads, or may be a constant-speed type compressor. In the case of the constant-speed type compressor, it always discharges a pre-determined amount of refrigerant, and the cooling capability can be changed by adjusting the distributor 300 or other various expanders or valves, or the like.

The distributor 300 serves to distribute the condensed refrigerant, discharged from the condensing unit 200, into the first refrigerant flow-path 410 and the second refrigerant flow-path 510, respectively. The distributor 300, for example, may be realized by a 3-way valve.

The cold air generating units 400 and 500 include a first cold air generating unit 400 and a second cold air generating unit 500. The first cold air generating unit 400 includes the first refrigerant flow-path 410, a first expander 420 installed on the first refrigerant flow-path 410 and used to expand the refrigerant, and a first evaporating unit 430 to evaporate the refrigerant expanded in the expander 420, so as to generate cold air of different temperature bands from one another.

The first evaporating unit 430 includes a first-band evaporator 431 to primarily evaporate the expanded refrigerant from the first expander 420 so as to generate cold air, an intermediate expander 433 to again expand the evaporated refrigerant having passed through the first-band evaporator 431, and a second-band evaporator 432 to secondarily evaporate the expanded refrigerant having passed through the intermediate expander 433 so as to generate cold air.

The second cold air generating unit 500 includes the second refrigerant flow-path 510, a second expander 520 installed on the second refrigerant flow path 510 and used to expand the refrigerant, an evaporator 530 to evaporate the refrigerant expanded in the second expander 520 so as to generate cold air, and a connector 540 to connect the second refrigerant flow-path 510 and the first refrigerant flow-path 410 to each other for the selective flow of the refrigerant, the connector 540 having the effects of reducing a pressure difference between the refrigerant having passed through the first evaporating unit 430 and the refrigerant flowing through the second refrigerant flow-path 510, and of adjusting the superheating degree of the refrigerant having passed through the first evaporating unit 430.

The first cold air generating unit 400 and the second cold air generating unit 500 are adapted to generate cold air of different temperature bands from each other. Herein, the following description is related to the case where the temperature band of cold air generated from the first cold air generating unit 400 is higher than the temperature band of cold air generated from the second cold air generating unit 500.

Now, a cold air generating mechanism of the refrigeration-cycle apparatus shown in FIG. 3 will be described with reference to FIG. 9.

Referring first to a PH diagram shown in FIG. 9, the procedure "1→2" represents a refrigerant compressing procedure by the compressor 100, the procedure "2→3→4" represents a refrigerant condensing procedure by the condensing unit 200, the procedure "4→R11" represents a refrigerant expanding procedure by the first expander 420, and the procedure "4→5" represents a refrigerant expanding procedure by the second expander 520.

The procedure "R11→R12" represents a refrigerant evaporating procedure for generating cold air by the first-band evaporator 431, the procedure "R12→R21" represents a refrigerant expanding procedure, i.e. a pressure drop procedure by the intermediate expander 433, and the procedure "R21→R22" represents a refrigerant evaporating procedure for generating cold air by the second-band evaporator 432.

Meanwhile, the procedure "5→1" represents a refrigerant evaporating procedure for generating cold air by the evaporator 530 of the second cold air generating unit 500.

The second cold air generating unit 500 performs a refrigeration cycle in the sequence of 1→2→3→4→5→1, and the first cold air generating unit 400 performs a refrigeration cycle in the sequence of R22→2→3→4→R11→R12→R21→R22.

In FIG. 3, since the first cold air generating unit 400 is adapted to generate cold air having a higher temperature band than that of the second cold air generating unit 500, the first expander 420 has a shorter length than that of the second expander 520, and consequently, the second expander 520 has a greater pressure drop than that of the first expander 420. Accordingly, the refrigerant having passed through the second expander 520 is a low-temperature and low-pressure liquid-phase refrigerant. While passing through the evaporator 530, the low-temperature and low-pressure liquid-phase refrigerant is evaporated, and draws heat from the surroundings, thereby generating cold air. In this case, the cold air has a temperature of about −15 to −30 degrees centigrade. The above described evaporation for generating cold air corresponds to the procedure "5→1" on the graph of FIG. 9.

On the other hand, the refrigerant having passed through the first expander 420 is primarily evaporated while passing through the first-band evaporator 431, thereby generating cold air. As can be confirmed from the graph of FIG. 9, the refrigerant passes through the first-band evaporator 431 in a state wherein the pressure of the refrigerant is incompletely dropped. Therefore, a great amount of the refrigerant remains in a liquid-phase state. This means that the first cold air generating unit 400 draws a smaller amount of heat from the surroundings during the evaporation of the refrigerant than the second cold air generating unit 500, and realizes a higher temperature band than the second cold air generating unit 500. The first-band evaporator 431 has a temperature band of 5 to −1 degrees centigrade. The above described evaporation for generating cold air corresponds to the procedure "R11→R12" on the graph of FIG. 9.

The refrigerant having passed through the first-band evaporator 431 is again expanded while passing through the intermediate expander 433. This expansion corresponds to the procedure "R12→R21" The expanded refrigerant is secondarily evaporated while passing through the second-band evaporator 432, thereby generating cold air. The cold air generated from the second-band evaporator 432 has a temperature band of about −1 to −7 degrees centigrade. The above described evaporation for generating cold air corresponds to the procedure "R21→R22" on the graph of FIG. 9.

Thereafter, the refrigerant having passed through the first cold air generating unit 400 and the second cold air generating unit 500 is again introduced into the compressor 100, to proceed a next cycle. In this case, since the refrigerant having passed through the second cold air generating unit 500 has a lower pressure than that of the refrigerant having passed through the first cold air generating unit 400, there is a risk that the refrigerant having passed through the first cold air generating unit 400 flows backward to the second cold air generating unit 500. To eliminate the backflow of the refrigerant, a check valve 550 is installed downstream of the second cold air generating unit 500.

However, although the check valve 550 can prevent the backflow of the refrigerant to the second cold air generating unit 500, there still exists a problem in that the refrigerant having passed through the second cold air generating unit 500 cannot be introduced into the compressor 100 due to the above described pressure difference. Therefore, to reduce the pressure difference and to allow the overall refrigerant to be completely returned to the compressor 100, the connector 540 is provided to connect a position upstream of the second cold air generating unit 500 and a position downstream of the first cold air generating unit 400 to each other.

The connector 540, as shown in FIG. 3, is installed to connect the second refrigerant flow-path 510 and the first refrigerant flow-path 410 to each other. The connector 540 includes a connecting pipe 541 to connect a position downstream of the second expander 520 on the second refrigerant flow-path 510 to a position downstream of the second-band evaporator 432 on the first refrigerant flow path 410, and a control valve 542 installed on the connecting pipe 541 to control the flow of the refrigerant.

As can be seen from the graph shown in FIG. 9, when the procedure "R2'1→R2'2" occurs due to an insufficient pressure drop of the refrigerant, the first cold air generating unit 400 and the second cold air generating unit 500 have a great pressure difference. Therefore, the control valve 542 has to be opened, to reduce the pressure difference, and consequently, to assure the smooth circulation of the refrigerant.

It will be further appreciated that the refrigerant having passed through the first cold air generating unit 400 and the refrigerant having passed through the second cold air generating unit 500 have a great temperature difference. That is, the refrigerant has a high superheating degree. This is because the temperature of cold air generated from the first cold air generating unit 400 is higher than that of cold air generated from the second cold air generating unit 500. The high superheating degree is disadvantageous because of a high probability that the refrigerant to be returned to the compressor 100 is changed into a liquid-phase state rather than a gas-phase state.

Accordingly, under the condition of the high superheating degree, the control valve 542 has to be opened, to allow the refrigerant having passed through the first cold air generating unit 400 to be introduced into the second cold air generating unit 500. In this way, the problem of the superheating degree can be solved by bypassing the refrigerant having passed through the first cold air generating unit 400 into the second refrigerant flow path 510 through the connecting pipe 541.

Figure 4:
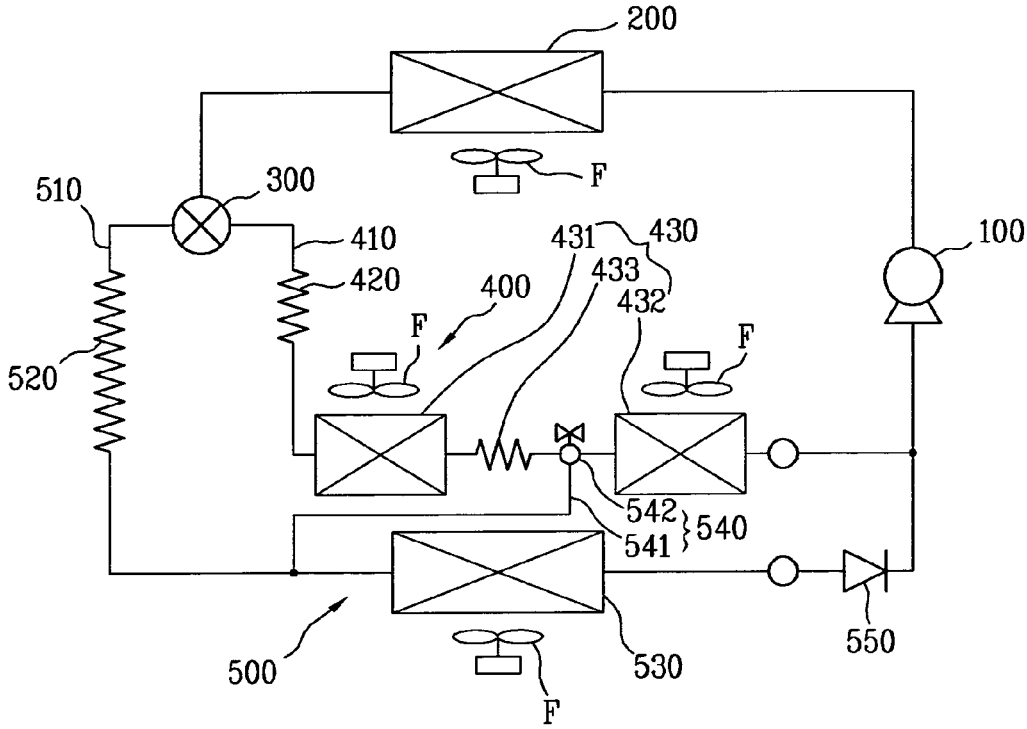

Referring to FIG. 4 illustrating a refrigeration-cycle apparatus according to another embodiment of the present invention, it has the same configurations and operational effects as those of the refrigeration-cycle apparatus shown in FIG. 3 except for the connector 540. Accordingly, the following description is related to the connector 540, and a detailed description of common parts is substituted by the above description of the refrigeration-cycle apparatus shown in FIG. 3.

The connector 540 of the refrigeration-cycle apparatus according to the embodiment shown in FIG. 4 includes the connecting pipe 541 to connect a position downstream of the second expander 520 on the second refrigerant flow-path 510 to a position between the intermediate expander 433 and the second-band evaporator 432 on the first refrigerant flow-path 410, and the control valve 542 installed on the connecting pipe 541 to control the flow of the refrigerant.

When the second-band evaporator 432 has an insufficient evaporation of the refrigerant and fails to generate cold air of a desired temperature, the connector 540 shown in FIG. 4 is operated in such a manner that the control valve 542 is opened to further lower the pressure of the refrigerant to be introduced into the second-band evaporator 432, thereby facilitating the evaporating operation of the second-band evaporator 432, and consequently, generating cold air of a desired temperature band.

Although FIGS. 3 and 4 illustrate the connector 540 installed to move the refrigerant, prior to or after passing through the second-band evaporator 432, into the second refrigerant flow-path 510, it may be also considered that the connectors are connected to both positions upstream and downstream of the second-band evaporator 432, so as to adjust the pressure and temperature of the refrigerant upstream and downstream of the second-band evaporator 432. In this case, there are preferably provided a first control valve to control the flow of the refrigerant upstream of the second-band evaporator 432 and a second control valve to control the flow of the refrigerant downstream of the second-band evaporator 432, such that the two control valves can be operated appropriately according to operating environments.

The refrigeration-cycle apparatuses according to the present invention shown in FIGS. 3 and 4 have a feature in that the first cold air generating unit 400 and the second cold air generating unit 500, which generate cold air of different temperature bands from each other by use of the refrigerant distributed from the condensing unit 200, are connected parallel to each other, and in turn, the first cold air generating unit 400 includes the two evaporators 431 and 432 connected in series to generate cold air of different temperature bands from each other by the stepwise expansion and evaporation of the refrigerant, whereby the refrigeration-cycle apparatuses can generate cold air of various temperature bands including a high temperature band, a medium temperature band, and a low temperature band. With the use of the refrigeration-cycle apparatuses, the refrigerator having cooling compartments of various temperature bands as shown in FIGS. 1 and 2 can be realized.

More specifically, as shown in FIGS. 3 and 4, the refrigeration-cycle apparatuses according to the present invention include the compressor 100 to compress and discharge a refrigerant, the condensing unit 200 having at least one condenser to condense the refrigerant discharged from the compressor 100, and a refrigeration-cycle unit to simultaneously or selectively perform a plurality of refrigeration-cycle operations using the condensed refrigerant from the condensing unit 200, so as to generate cold air of various temperature bands. This configuration has a feature in that a single refrigeration-cycle apparatus can realize a plurality of refrigeration cycles, and all the plurality of refrigeration cycles can be operated simultaneously or some of the refrigeration cycles are operated selectively, to generate cold air of various temperature bands. Here, the refrigeration-cycle unit includes, for example, the distributor 300, and the cold air generating units 400 and 500.

Figure 5:
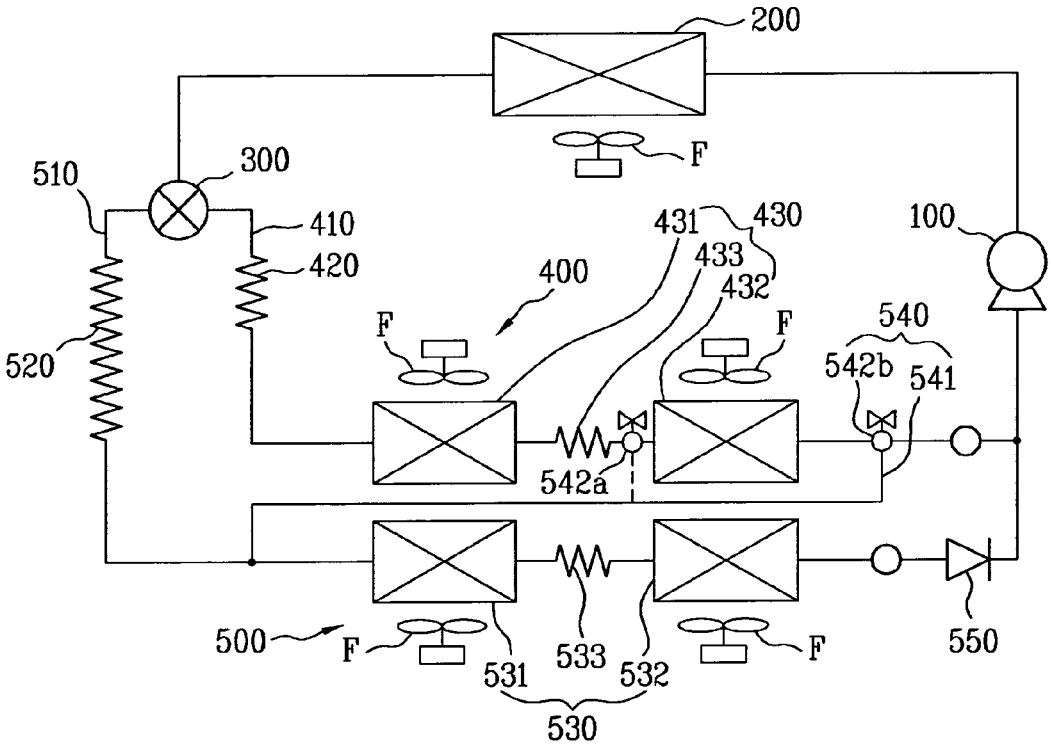
Figure 6:
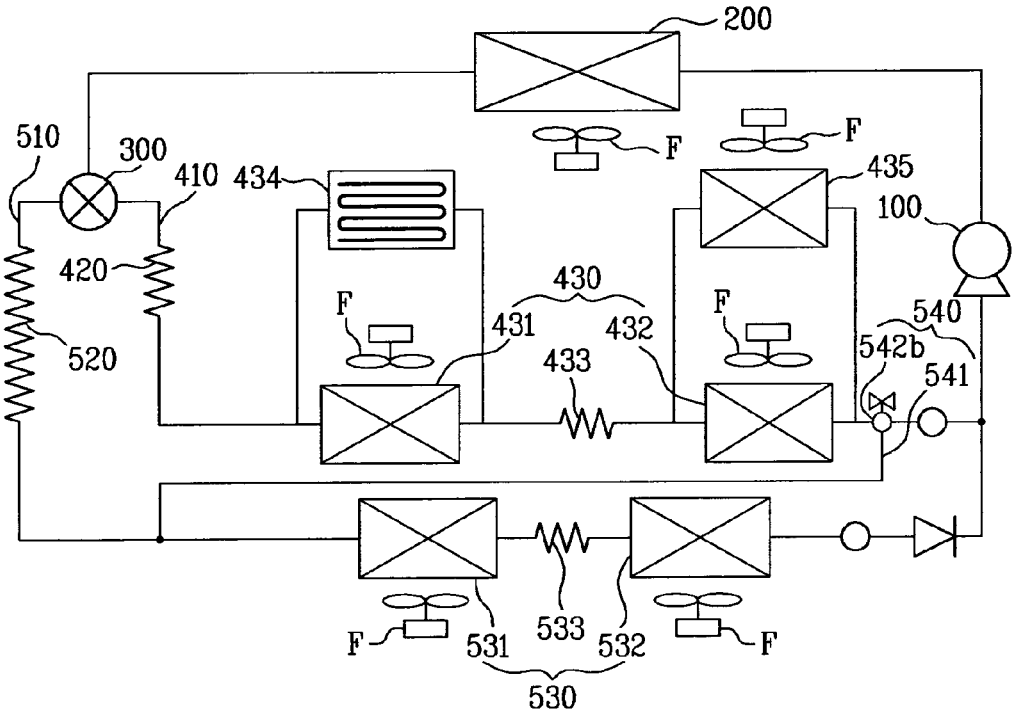

Although the embodiments shown in FIGS. 3 and 4 illustrate that the two evaporators 431 and 432 of the first cold air generating unit 400 are connected in series, and the second cold air generating unit 500 includes only the single evaporator 530, it may be considered that the first cold air generating unit 400 includes three or more evaporators connected in series to generate cold air of more various temperature bands, and that the second cold air generating unit 500 similarly includes a plurality of evaporators connected in series to generate cold air of various temperature bands. Such a configuration in which the second cold air generating unit 500 includes a plurality of evaporators connected in series is illustrated in FIGS. 5 and 6, and will be described hereinafter.

Meanwhile, in an alternative embodiment of the present invention, instead of distributing the refrigerant from the distributor 300 into the first refrigerant flow-path 410 and the second refrigerant flow-path 510, it may be considered that the refrigerant is distributed into first to third refrigerant flow-paths, and evaporators are installed on the respective refrigerant flow-paths in such a manner of being connected in series and parallel to one another. It may be also considered that there are provided four or more refrigerant flow-paths such that the refrigerant is distributed into the respective refrigerant flow-paths to induce the operation of a plurality of evaporators.

In another alternative embodiment, an additional evaporator may be installed to be connected parallel to each evaporator. Also, some of the evaporators may be an indirect-cooling type to realize a general cooling compartment, and some of the evaporators may be a direct-cooling type to realize a cooling compartment for a Kim-chi refrigerator. Herein, the second cooling compartment 620 shown in FIG. 1 is provided with a direct-cooling type evaporator, and serves as a cooling compartment for a Kim-chi refrigerator.

In FIGS. 3 and 4, reference character "F" designates blowing fans installed, respectively, to the condensing unit 200 and the respective evaporators, to induce the exchange of heat. In the drawings to be described hereinafter, all the reference characters "F" designate the blowing fan.

Referring to FIG. 5, a refrigeration-cycle apparatus according to a further embodiment of the present invention includes the compressor 100 to compress and discharge a refrigerant, the condensing unit 200 connected to the compressor 100 and used to condense the compressed refrigerant, the distributor 300 to distribute the refrigerant having passed through the condensing unit 200 into the first refrigerant flow-path 410 and the second refrigerant flow-path 510, and the cold air generating units 400 and 500 including a plurality of evaporators 431, 432, 531, and 532 installed on the first refrigerant flow-path 410 and the second refrigerant flow-path 510 in such a manner of being connected in series and parallel to one another, to generate cold air of different temperature bands from one another.

The compressor 100 and the distributor 300 are identical to those of FIGS. 3 and 4, and a description thereof will be omitted.

The cold air generating units 400 and 500 include the first cold air generating unit 400 and the second cold air generating unit 500. The first cold air generating unit 400 includes the first refrigerant flow-path 410, the first expander 420 installed on the first refrigerant flow-path 410 and used to expand the refrigerant, and the first evaporating unit 430 to evaporate the refrigerant expanded in the first expander 420 so as to generate cold air of different temperature bands from one another. The first evaporating unit 430 includes the first-band evaporator 431 to primarily evaporate the expanded refrigerant from the first expander 420 so as to generate cold air, a first intermediate expander 433 to again expand the evaporated refrigerant having passed through the first-band evaporator 431, and the second-band evaporator 432 to secondarily evaporate the refrigerant having passed through the first intermediate expander 433, so as to generate cold air.

The second cold air generating unit 500 includes the second refrigerant flow-path 510, the second expander 520 installed on the second refrigerant flow-path 510 and used to expand the refrigerant, and a second evaporating unit 530 to evaporate the refrigerant expanded in the second expander 520 so as to generate cold air of different temperature bands from one another. The second evaporating unit 530 includes a third-band evaporator 531 to primarily evaporate the expanded refrigerant from the second expander 520 so as to generate cold air, a second intermediate expander 533 to again expand the evaporated refrigerant having passed through the third-band evaporator 531, a fourth-band evaporator 532 to secondarily evaporate the expanded refrigerant having passed through the second intermediate expander 533 so as to generate cold air, and the connector 540 to reduce a pressure difference between the refrigerant having passed through the first evaporating unit 430 and the refrigerant flowing through the second refrigerant flow-path 510 and to adjust the superheating degree of the first evaporating unit 430.

The connector 540, as shown in FIG. 5, includes the connecting pipe 541 and a control valve to open or close the connecting pipe 541 so as to control the flow of the refrigerant. In the present embodiment, the control valve may include at least one of a first control valve 542*a* and a second control valve 542*b*. The function of the control valves is identical to the description of FIGS. 3 and 4, and a detailed description thereof will be omitted.

In the refrigeration-cycle apparatus shown in FIG. 5, the first cold air generating unit 400 and the second cold air generating unit 500 are connected parallel to each other. The first cold air generating unit 400 includes the first-band evaporator 431 and the second-band evaporator 432 connected in series, and the second cold air generating unit 500 includes the third-band evaporator 531 and the fourth-band evaporator 532 connected in series. In this configuration, the four evaporators can be configured to generate cold air of different temperature bands from one another.

A cold air generating mechanism of the first cold air generating unit 400 is identical to the description of FIGS. 3 and 4, and also, a cold air generating mechanism of the second cold air generating unit 500 is substantially identical to that of the first cold air generating unit 400. Thus, a detailed description thereof will be omitted.

Referring to FIG. 6 illustrating a refrigeration-cycle apparatus according to a still further embodiment of the present invention, the first cold air generating unit 400 further includes a first parallel-connection evaporator 434 connected parallel to the first-band evaporator 431, and a second parallel-connection evaporator 435 connected parallel to the second-band evaporator 432.

The first parallel-connection evaporator 434 and the second parallel-connection evaporator 435 are adapted to receive approximately the same refrigerant as that to be introduced into the first-band evaporator 431 and the second-band evaporator 432, respectively. Accordingly, the first-band evaporator 431 and the first parallel-connection evaporator 434 can generate cold air of temperature bands almost similar to each other, and the second-band evaporator 432 and the second parallel-connection evaporator 435 can generate cold air of temperature bands almost similar to each other. In the embodiment of FIG. 6, the first parallel-connection evaporator 434 is realized as a direct-cooling type, and the second parallel-connection evaporator 435 is realized as an indirect-cooling type.

The refrigeration-cycle apparatus of the present embodiment is substantially identical to the refrigeration-cycle apparatus shown in FIG. 5 except for the above described configuration, and a detailed description thereof will be omitted.

Figure 7:
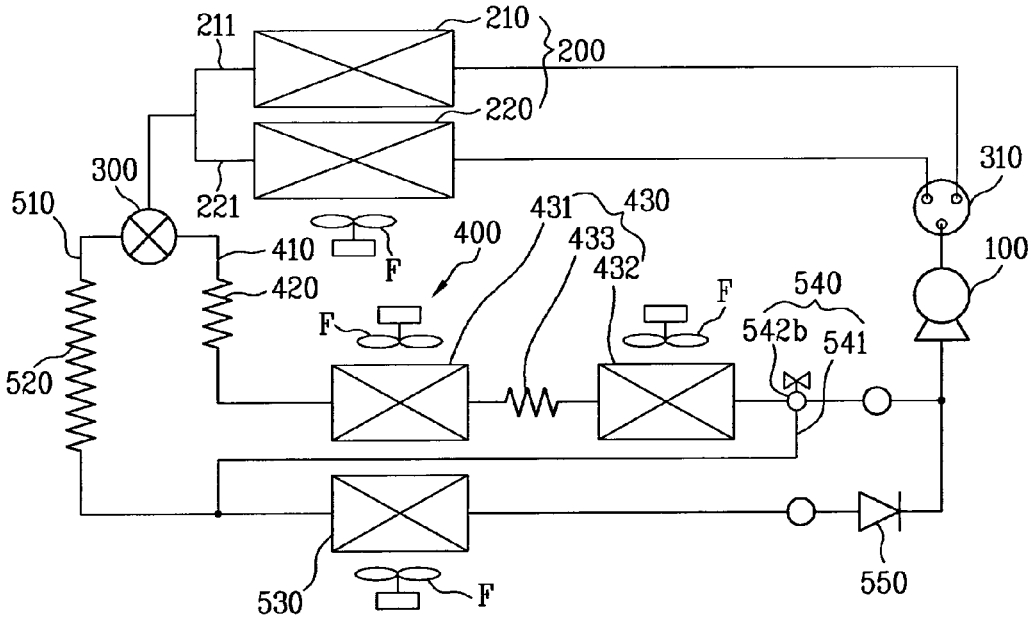
Figure 8:
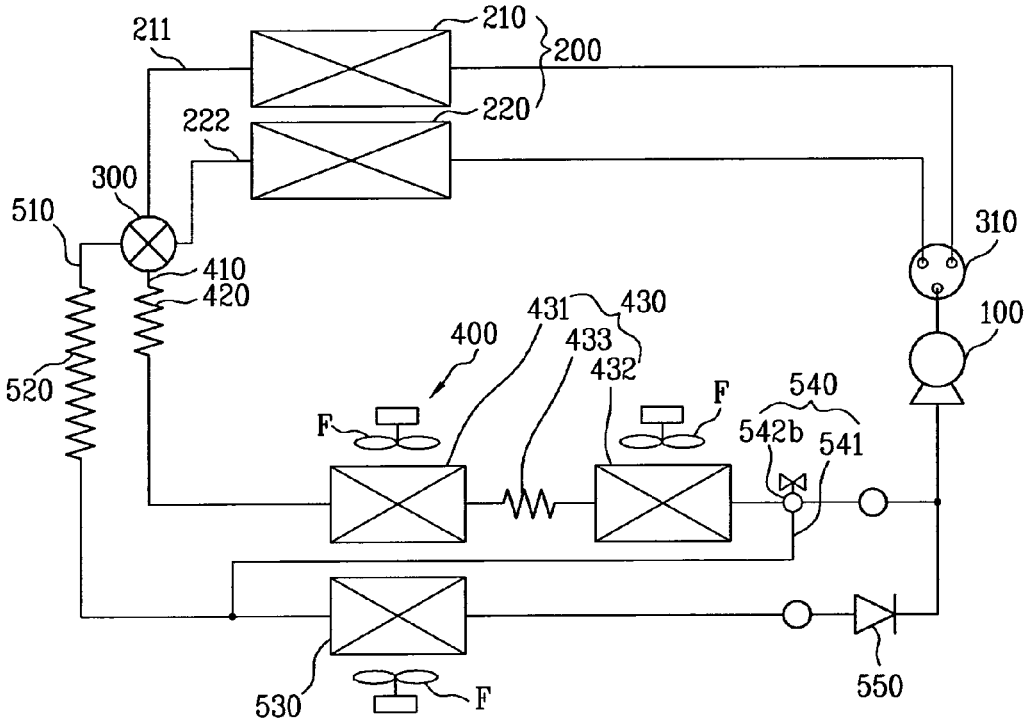
Figure 9:
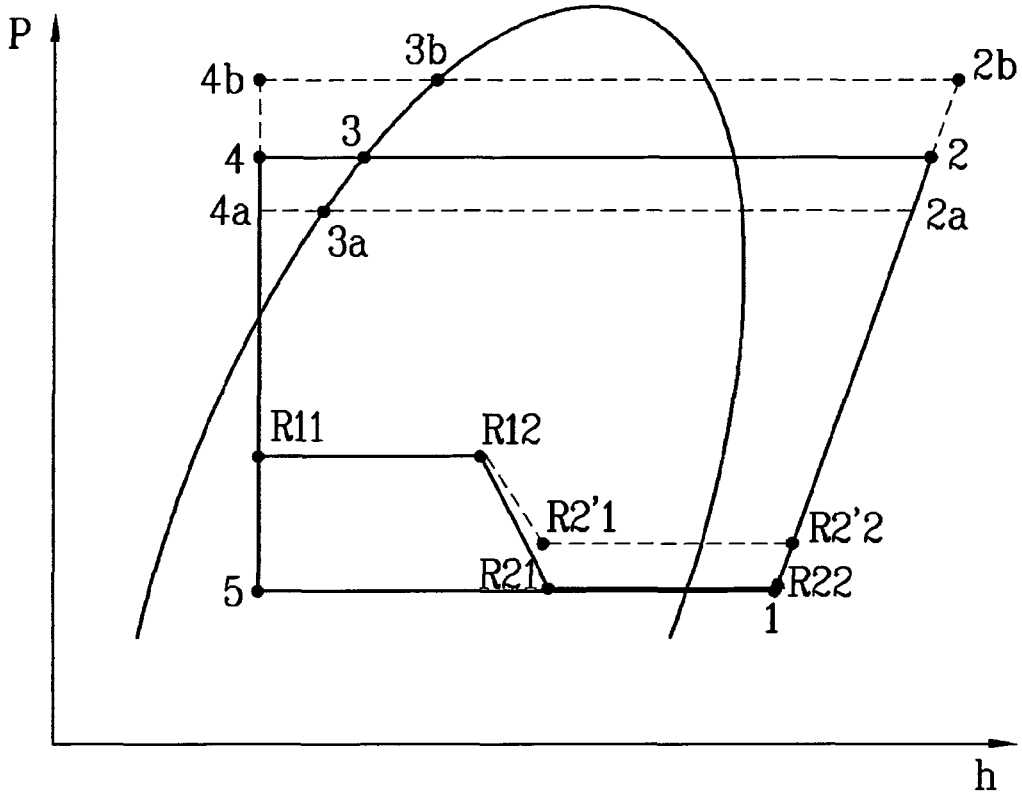
FIG. 9 is a PH diagram related to a refrigeration cycle realized by the refrigeration-cycle apparatus according to the present invention.

Referring to FIGS. 7 and 8 illustrating other embodiments of the present invention, there is provided a condensing unit including a plurality of condensers. In the embodiments shown in FIGS. 7 and 8, the configuration of the evaporators is identical to that of the embodiments shown in FIGS. 3 to 6, and thus, a detailed description thereof will be omitted. Accordingly, the following description of the refrigeration-cycle apparatuses shown in FIGS. 7 and 8 is concentrated on the condensing unit including the plurality of condensers.

The refrigeration-cycle apparatus shown in FIG. 7 includes the compressor 100, and the condensing unit 200 including a plurality of condensers, namely, a first condenser 210 and a second condenser 220. A distribution valve 310 is installed between the compressor 100 and the condensing unit 200. The distribution valve 310 is used to distribute the refrigerant discharged from the compressor 100 into the first condenser 210 and the second condenser 220. The distribution valve 310, for example, may be a 3-way valve.

The first condenser 210 and the second condenser 220 are used to condense the refrigerant to be introduced into the first cold air generating unit 400 and the second cold air generating unit 500, respectively. Accordingly, the first condenser 210 and the second condenser 220 may have different sizes from each other.

FIG. 9 illustrates a PH diagram of the refrigeration-cycle apparatus to achieve a refrigerant condensing operation suitable for different loads of evaporators with the use of the first condenser and the second condenser.

Specifically, as can be seen from the PH diagram shown in FIG. 9, the amount of heat emitted from the condensing unit by the refrigerant circulating through the refrigeration cycle can be changed according to whether any one of the condensers 210 and 220 is used selectively or all the condensers 210 and 220 are used simultaneously. That is, the condensers can be operated such that the condensation efficiency is adjusted to conform to the size and load of the evaporators. Here, the emission amount of heat is changed according to the length of the procedure"2*a*→3*a*→4*a*" or the procedure"2*b*→3*b*→4*b*". The great emission amount of heat means that a great amount of the refrigerant is condensed.

As shown in FIG. 9, when some of the plurality of evaporators included in the refrigeration-cycle apparatus are operated, the refrigerant proceeds along the procedure "2*a*→3*a*→4*a*". Also, when it is necessary to condense a greater amount of the refrigerant by operation of an increased number of evaporators, the refrigerant proceeds along the procedure "2*b*→3*b*→4*b*". Here, the procedure "2*a*→3*a*→4*a*" and the procedure "2*b*→3*b*→4*b*" are on the basis of different discharge pressures of the refrigerant obtained by the use of a variable-capacity compressor. In conclusion, refrigeration-cycles suitable for different loads of the respective evaporators can be selectively realized.

Accordingly, when only one of the first cold air generating unit 400 and the second cold air generating unit 500 is operated, the condenser corresponding to the cold air generating unit can be selectively operated. This has the effect of greatly reducing the loss of condensation as compared to the use of a large single condenser. Also, when all the first cold air generating unit 400 and the second cold air generating unit 500 are operated, the two condensers can be operated simultaneously, thereby increasing the condensation efficiency of the refrigerant, and resulting in improved system efficiency.

In the case of the refrigeration cycle shown in FIG. 7, pipes 211 and 221 of the first condenser 210 and the second condenser 220 are merged and connected to the distributor 300 by means of a single common pipe 230. In this case, therefore, it is preferable to sequentially use the first condenser 210 and the second condenser 220 having different condensation capacities from each other, rather than simultaneously using the first condenser 210 and the second condenser 220.

In the present embodiment, the distributor 300 has to convert a refrigerant distributing direction to the first refrigerant flow-path 410 or the second refrigerant flow-path 510 on the basis of the capacity of each condenser. For this reason, a direction convertible device, for example, a 3-way valve may be used as the distributor 300.

In yet another embodiment of the present invention shown in FIG. 8, the pipes 211 and 221 of the first condenser 210 and the second condenser 220 are directly connected to the distributor 300, to thereby be connected to the first refrigerant flow-path 410 and the second refrigerant flow-path 510, respectively. In the present embodiment, the distributor 300 has no need to convert the flow direction of the refrigerant having passed through the first condenser 210 and the second condenser 220, and only serves to control a connection between the pipe 211 of the first condenser 210 and the first refrigerant flow-path 410 or to control a connection between the pipe 221 of the second condenser 220 and the second refrigerant flow-path 510.

The refrigeration-cycle apparatus according to the embodiment shown in FIG. 8 is substantially identical to the refrigeration-cycle apparatus according to the embodiment shown in FIG. 7 except for the configurations of the condensers, distributor, and pipes, and thus, a detailed description thereof will be omitted.

Meanwhile, although FIGS. 7 and 8 illustrate the condensing unit 200 having the two condensers, it will be appreciated that the present invention is not limited thereto, and a condensing unit having three or more condensers can be used to realize the above described refrigeration cycle.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As apparent from the above description, a refrigeration-cycle apparatus and a refrigerator according to the present invention can realize a plurality of evaporators having different temperature bands from one another, thereby realizing cooling compartments enabling cooling operations in various temperature bands, and satisfying various demands of consumers. Further, as a result of providing each cooling compartment with an independent evaporator, the refrigerator is very advantageous not only to maintain an interior humidity of the refrigerator, but also to achieve the accurate control of an interior temperature of the refrigerator. In particular, the present invention can allow the respective evaporators to be operated individually, and reduce the consumption of energy.

The invention claimed is:

1. A refrigeration-cycle apparatus, comprising:

a compressor that compresses and discharges a refrigerant;

a condensing device that includes at least one condenser that condenses the refrigerant discharged from the compressor;

a distributor that distributes the refrigerant condensed in the condensing device; and a cold air generator that includes a plurality of evaporators that each evaporates the refrigerant distributed by the distributor, the plurality of evaporators being connected in series and parallel to one another and operated, respectively, to generate cold air having different temperature bands from one another, wherein the cold air generator comprises:

a first cold air generator that generates cold air from a portion of the refrigerant distributed from the distributor; and a second cold air generator that is connected in parallel to the first cold air generator and generates cold air from a remaining portion of the refrigerant distributed from the distributor, wherein the second cold air generator has a selective refrigerant flow with the first cold air generator, wherein the first cold air generator comprises:

a first refrigerant flow-path connected to the distributor;

a first expander installed on the first refrigerant flow-path, that expands the refrigerant; and a plurality of first evaporators connected in series to evaporate the refrigerant expanded in the first expander, so as to generate cold air having different temperature bands from one another, wherein the plurality of first evaporators comprises:

a first-band evaporator that evaporates the refrigerant so as to generate cold air having a predetermined temperature band;

a second-band evaporator that further evaporates the refrigerant which has passed through the first-band evaporator, so as to generate cold air having a lower temperature band than that of the first-band evaporator; and an intermediate expander installed between the first-band evaporator and the second-band evaporator, that expands the refrigerant which has passed through the first-band evaporator and introduces the expanded refrigerant into the second-band evaporator, and wherein the second cold air generator comprises:

a second refrigerant flow-path connected to the distributor;

a second expander installed on the second refrigerant flow-path, that expands the refrigerant;

at least one second evaporator that evaporates the refrigerant expanded in the second expander, so as to generate cold air; and a connector that connects the first refrigerant flow-path and the second refrigerant flow-path to each other between a point downstream of the second-band evaporator or the intermediate expander at least one of the plurality of first evaporators and a point upstream of the at least one second evaporator, to provide a selective refrigerant flow between the first refrigerant flow-path and the second refrigerant flow-path, so as to reduce a pressure difference between the refrigerant having passed through the at least one of the plurality of first evaporators and the refrigerant flowing through the second refrigerant flow-path, and to adjust a superheating degree of the refrigerant having passed through the at least one of the plurality of first evaporators, wherein the first expander has a shorter length than a length of the second expander, so that the second expander had a greater pressure drop than a pressure drop of the first expander.

2. The apparatus according to claim 1, wherein the distributor comprises a valve that supplies the condensed refrigerant from the condensing device into the first cold air generator and the second cold air generator simultaneously or selectively.

3. The apparatus according to claim 1, wherein the at least one second evaporator includes a plurality of evaporators connected in series to evaporate the refrigerant expanded in the second expander, so as to generate cold air having different temperature bands from one another.

4. The apparatus according to claim 1, wherein the plurality of first evaporators further comprises:

at least one parallel-connection evaporator connected in parallel to at least one of the first-band evaporator or the second-band evaporator to generate cold air.

5. The apparatus according to claim 4, wherein at least one of the first-band evaporator, the second-band evaporator, or the at least one parallel-connection evaporator includes an indirect-cooling type evaporator.

6. The apparatus according to claim 1, wherein the condensing device comprises:

a first condenser that condenses the refrigerant to be supplied into the first cold air generator; and a second condenser that condenses the refrigerant to be supplied into the second cold air generator.

7. The apparatus according to claim 6, further comprising:

a distribution valve that distributes and supplies the refrigerant discharged from the compressor into the first condenser and the second condenser.

8. The apparatus according to claim 1, wherein the connector comprises:

a connecting pipe that connects a point downstream of the plurality of first evaporators to a point downstream of the second expander; and a control valve that controls the flow of the refrigerant through the connecting pipe.

9. The apparatus according to claim 1, wherein the connector comprises:

a connecting pipe that connects a point between the plurality of first evaporators to a point downstream of the second expander; and a control valve that controls the flow of the refrigerant through the connecting pipe.

10. A refrigeration-cycle apparatus, comprising:

a compressor that compresses and discharges a refrigerant;

a condensing device that includes at least one condenser that condenses the refrigerant discharged from the compressor; and a refrigeration-cycle device that simultaneously or selectively performs a plurality of refrigeration-cycle operations using the condensed refrigerant from the condensing device, so as to enable cooling operations in various temperature bands, wherein the refrigeration-cycle device comprises:

a distributor that distributes the refrigerant condensed in the condensing device into a plurality of passages simultaneously or into only a portion of the plurality of passages, selectively;

a first cold air generator that performs a refrigeration-cycle operation using a portion of the refrigerant distributed by the distributor; and a second cold air generator that performs another refrigeration-cycle operation using a remaining portion of the refrigerant distributed by the distributor, wherein the first cold air generator comprises:

a first refrigerant flow-path connected to the distributor;

a first expander installed on the first refrigerant flow-path, that expands the refrigerant; and a plurality of first evaporators connected in series to evaporate the refrigerant expanded in the first expander, so as to generate cold air having different temperature bands from one another, wherein the plurality of first evaporators comprises:

a first-band evaporator that evaporates the refrigerant so as to generate cold air having a predetermined temperature band;

a second-band evaporator that further evaporates the refrigerant which has passed through the first-band evaporator, so as to generate cold air having a lower temperature band than that of the first-band evaporator; and an intermediate expander installed between the first-band evaporator and the second-band evaporator, that expands the refrigerant which has passed through the first-band evaporator and introduces the expanded refrigerant into the second-band evaporator, and wherein the second cold air generator comprises:

a second refrigerant flow-path connected to the distributor;

a second expander installed on the second refrigerant flow-path, that expands the refrigerant;

at least one second evaporator that evaporates the refrigerant expanded in the second expander, so as to generate cold air; and a connector that connects the first refrigerant flow-path and the second refrigerant flow-path to each other between a point downstream of the second-band evaporator or the intermediate expander at least one of the plurality of first evaporators and a point upstream of the at least one second evaporator, to provide a selective refrigerant flow between the first refrigerant flow-path and the second refrigerant flow-path, so as to reduce a pressure difference between the refrigerant having passed through the at least one of the plurality of first evaporators and the refrigerant flowing through the second refrigerant flow-path, and to adjust a superheating degree of the refrigerant having passed through the at least one of the plurality of first evaporators wherein the first expander has a shorter length than a length of the second expander, so that the second expander had a greater pressure drop than a pressure drop of the first expander.

11. A refrigerator, comprising:

a body;

a refrigeration-cycle apparatus installed in the body, and including a compressor that compresses and discharges a refrigerant, a condensing device that condenses the refrigerant discharged from the compressor, a distributor that distributes the refrigerant condensed in the condensing device, a first cold air generator that generates cold air from a portion of the refrigerant distributed from the distributor, and a second cold air generator that is connected to the first cold air generator and generates cold air from a remaining portion of the refrigerant distributed from the distributor, the second cold air generator having a selective refrigerant flow with the first cold air generator; and a plurality of cooling compartments provided in the body and adapted to be cooled, respectively, by cold air, having different temperature bands from one another, generated from the first cold air generator and the second cold air generator, wherein the first cold air generator comprises:

a first refrigerant flow-path connected to the distributor;

a first expander installed on the first refrigerant flow-path, that expands the refrigerant; and a plurality of first evaporators connected in series to evaporate the refrigerant expanded in the first expander, so as to generate cold air having different temperature bands from one another, wherein the plurality of first evaporators comprises:

a first-band evaporator that evaporates the refrigerant so as to generate cold air having a predetermined temperature band;

a second-band evaporator that further evaporates the refrigerant which has passed through the first-band evaporator, so as to generate cold air having a lower temperature band than that of the first-band evaporator; and an intermediate expander installed between the first-band evaporator and the second-band evaporator, that expands the refrigerant which has passed through the first-band evaporator and introduces the expanded refrigerant into the second-band evaporator, and wherein the second cold air generator comprises:

a second refrigerant flow-path connected to the distributor;

a second expander installed on the second refrigerant flow-path, that expands the refrigerant;

at least one second evaporator that evaporates the refrigerant expanded in the second expander, so as to generate cold air; and a connector that connects the first refrigerant flow-path and the second refrigerant flow-path to each other between a point downstream of the second-band evaporator or the intermediate expander at least one of the plurality of first evaporators and a point upstream of the at least one second evaporator, to provide a selective refrigerant flow between the first refrigerant flow-path and the second refrigerant flow-path, so as to reduce a pressure difference between the refrigerant having passed through the at least one of the plurality of first evaporators and the refrigerant flowing through the second refrigerant flow-path, and to adjust a superheating degree of the refrigerant having passed through the at least one of the plurality of first evaporators wherein the first expander has a shorter length than a length of the second expander, so that the second expander had a greater pressure drop than a pressure drop of the first expander.

12. The refrigerator according to claim 11, wherein a portion of the plurality of cooling compartments includes a plurality of cooling storage compartments to be cooled, respectively, by the cold air, having different temperature bands from one another, generated by the plurality of first evaporators included in the first cold air generator.

13. The refrigerator according to claim 12, wherein a remaining portion of the plurality of cooling compartments comprises at least one cooling storage compartment to be cooled by the at least one second evaporator of the second cold air generator.

14. The refrigerator according to claim 12, wherein the second cold air generator comprises a plurality of second evaporators connected in series and used, respectively, to generate the cold air having different temperature bands from one another, and wherein the remaining portion of the plurality of cooling compartments comprises a plurality of cooling storage compartments to be cooled, respectively, by the cold air, having different temperature bands from one another, generated by the plurality of second evaporators included in the second cold air generator.

15. The refrigerator according to claim 11, wherein one of the plurality of cooling compartments comprises a plurality of cooling spaces partitioned therein to be cooled, respectively, by the cold air, having different temperature bands from one another, generated by the plurality of first evaporators included in the first cold air generator.

16. The refrigerator according to claim 11, wherein a portion of the plurality of cooling compartments comprises a direct-cooling type cooling compartment realized by at least one direct-cooling type evaporator included in the first cold air generator or the second cold air generator.

17. The apparatus according to claim 1, wherein a check valve is installed downstream of the second cold air generator, that prevents a backflow of the refrigerant to the second cold air generator.

18. The apparatus according to claim 1, wherein the condensing device comprises a first condenser and a second condenser, wherein the first condenser and the second condenser are connected to each other at a downstream position and connected to the distributor to supply the condensed refrigerant to the distributor.

19. The apparatus according to claim 18, further comprising:

a distribution valve that distributes and supplies the refrigerant discharged from the compressor into the first condenser and the second condenser.

20. The apparatus according to claim 19, wherein the distribution valve is a three-way valve.

* * * * *